US006193545B1

(12) United States Patent
Lee et al.

(10) Patent No.: US 6,193,545 B1
(45) Date of Patent: Feb. 27, 2001

(54) CABLE CONNECTOR

(75) Inventors: George Lee, Taipei; Kuei-Chang Hsu, Long-Tan; Yen-Chao Tsai, Pan-Chiao, all of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/237,139

(22) Filed: Jan. 25, 1999

(30) Foreign Application Priority Data

Jan. 24, 1998 (TW) ..... 87201570

(51) Int. Cl.[7] ..... H01R 12/24
(52) U.S. Cl. ..... 439/497
(58) Field of Search ..... 439/497, 404, 439/405, 92, 108

(56) References Cited

U.S. PATENT DOCUMENTS

| | | | | |
|---|---|---|---|---|
| 4,027,941 | * | 6/1977 | Narozny | 439/402 |
| 4,095,862 | * | 6/1978 | Hatch | 439/402 |
| 4,641,904 | * | 2/1987 | Kosugi et al. | 439/404 |
| 5,161,987 | * | 11/1992 | Sinisi | 439/101 |
| 5,902,147 | * | 5/1999 | Jochen et al. | 439/497 |
| 5,967,832 | * | 10/1999 | Ploehn | 439/497 |
| 6,033,238 | * | 3/2000 | Fogg et al. | 439/108 |
| 6,077,105 | | 6/2000 | Jochen et al. | 439/497 |

* cited by examiner

*Primary Examiner*—Brian Sircus
*Assistant Examiner*—Brian S. Webb
(74) *Attorney, Agent, or Firm*—Wei Te Chung

(57) ABSTRACT

A cable connector 1 adapted to connect a flat cable 5 having plural parallel and alternately arranged signal conductors 51 and grounding conductors 52 retained in position with insulative material 50, includes an insulative pin carrier 20 defining a plurality of holes 211 therein each receiving a conductive pin 23. The holes 211 are arranged in two rows and the pins 23 are alternately received in the two rows. The two rows are separated by a partition along which a groove 25 is defined for receiving two conductive grounding plates 41, 42 therein. A cover 3 is attached to the pin carrier 20 and the flat cable 5 is interposed therebetween. Each of the pins 23 is provided with a bifurcated end 232 to complete insulation displacement of the corresponding signal conductor 51 of the flat cable 5 thereby establishing electrical connection therebetween. The first conductive grounding plate 41 has a plurality of bifurcated projections 411 to electrically connect with the grounding conductors 52 of the flat cable 5 in the insulation displacement fashion. The second conductive grounding plate 42, which is electrically connected to the first grounding plate 41, has at least one bifurcated projection 421 corresponding to and electrically connected with at least one of the signal conductors 51 which is to be provided with a grounding potential in an insulation displacement fashion. The cover 3 is provided with an inner surface defining a plurality of recesses 32 for respectively accommodating the signal and grounding conductors 51, 52 of the flat cable 5 therein.

17 Claims, 4 Drawing Sheets

CABLE CONNECTOR

BACKGROUND OF THE INVENTION

1. Field of the Invention

The present invention generally relates to a cable connector adapted to terminate/connect an electrical cable, particularly a flat ribbon cable comprising plural parallel signal and grounding conductors separated and housed by insulative material.

2. The Prior Art

Electrical connection between different electronic devices for signal transmission, such as that between a central processing unit and a peripheral device of a computer, is usually obtained by using electrical cables connected therebetween. There are different types of cables available on the market including flat ribbon cables which comprise a plurality of separate conductors for allowing simultaneous transmission of signals. Since a flat ribbon cable may comprise tens or hundreds of signal and/or grounding conductors, securing the flat ribbon cable to a cable connector requires individual connection of each of the conductors to a corresponding conductor in the cable terminator. To efficiently and effectively secure the flat ribbon cable to the cable connector, an insulation displacement connection (IDC) technique is usually employed. The IDC technique involves providing a sharpened edge or end on the conductor in the cable connector/terminator which forcibly pierces the insulation of the cable thereby establishing a physical contact with the conductor of the cable. Examples are disclosed in U.S. Pat. Nos. 4,190,952, 4,508,401, 4,596,428 and 4,749,371.

As the operational speed of computer central processing units increase, the frequency of signals transmitted through the flat ribbon cable is dramatically increased and significant electromagnetic interference between two adjacent conductors in the flat ribbon cable frequently occurs. Such a phenomenon is commonly referred to as "cross-talking" which adversely affects signal transmission quality and thus the stability of data transmission.

It is thus desirable to have a cable connector for terminating/connecting a flat ribbon cable which effectively suppresses the cross-talk problem encountered in the prior art.

SUMMARY OF THE INVENTION

Accordingly, an object of the present invention is to provide a cable connector which provides a better arrangement of individual wires of a cable for suppressing cross-talking and ensuring an acceptable signal transmission quality.

Another object of the present invention is to provide a cable connector having grounding means properly arranged for providing an electrical shielding which protects signal transmitting conductors of a cable from being interfered with by other conductors or external devices.

A further object of the present invention is to provide a cable connector which simultaneously provides a grounding potential to all the parts in a cable that require grounding thereby providing the cable with excellent shielding property.

To achieve the above objects, in accordance with the present invention, a cable connector adapted to connect a flat cable having plural parallel and alternately arranged signal conductors and grounding conductors retained in position with insulative material, comprises an insulative pin carrier defining a plurality of holes therein each receiving a conductive pin. The holes are arranged in two rows and the pins are alternately received in the two rows. The two rows are separated by a partition along which a groove is defined for receiving two conductive grounding plates therein. A cover is attached to the pin carrier and the flat cable is interposed therebetween. Each of the pins is provided with a bifurcated end to complete the insulation displacement connection of the corresponding signal conductor of the flat cable thereby establishing electrical connection therebetween. The first conductive grounding plate comprises a plurality of bifurcated projections to electrically connect with the grounding conductors of the flat cable in the insulation displacement fashion. The second conductive grounding plate, which is electrically connected to the first grounding plate, comprises at least one bifurcated projection corresponding to and electrically connected with at least one of the signal conductors which is to be provided with a grounding potential in an insulation displacement fashion. The cover is provided with an inner surface defining a plurality of recesses for respectively accommodating the signal and grounding conductors of the flat cable therein.

BRIEF DESCRIPTION OF THE DRAWINGS

The present invention will become apparent to those skilled in the art by reading the following description of a preferred embodiment thereof, with reference to the accompanying drawings, in which.

DETAILED DESCRIPTION OF THE PREFERRED EMBODIMENTS

Figure 1:
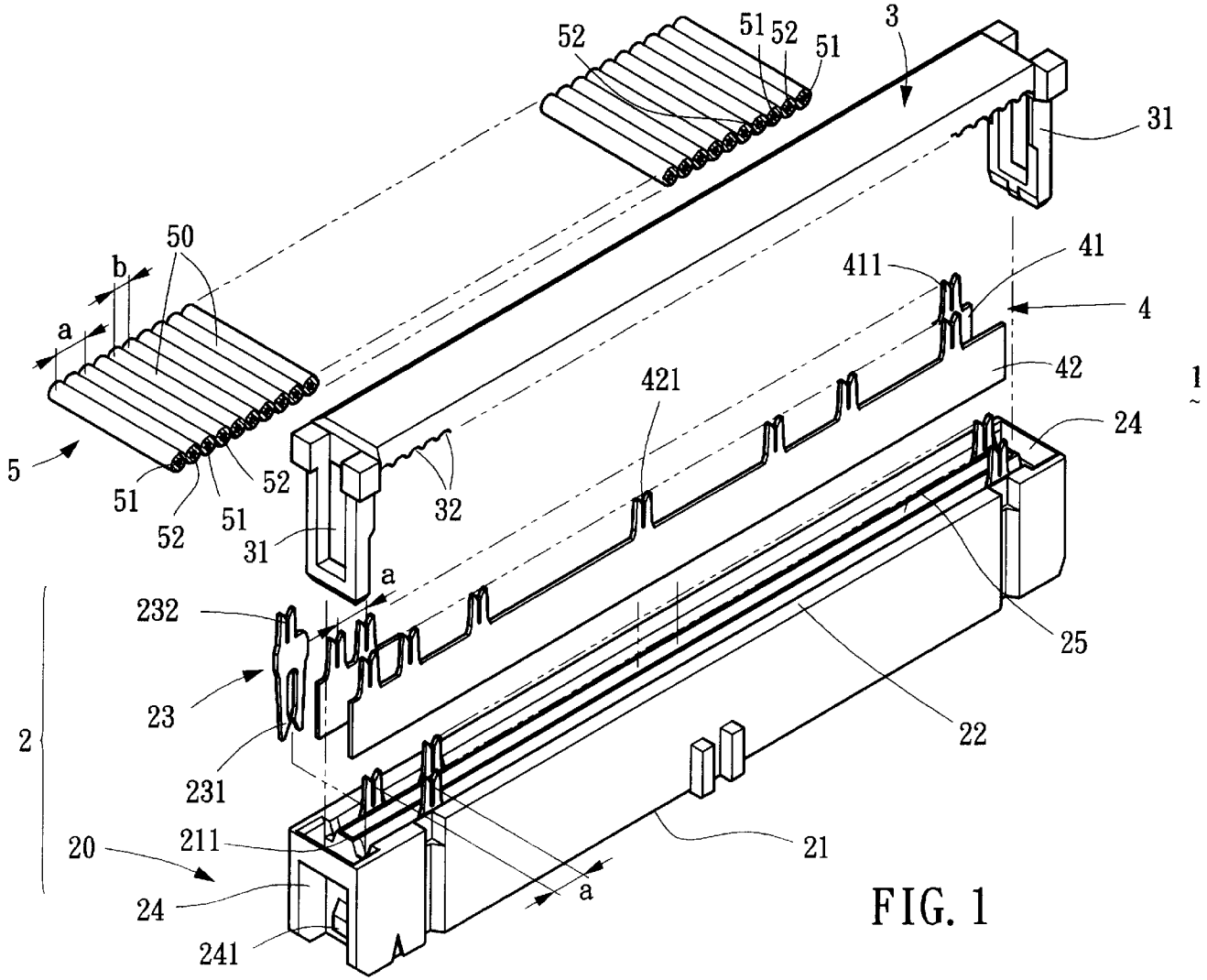
FIG. 1 is an exploded perspective view showing a cable connector constructed in accordance with the present invention.

With reference to the drawings, wherein like reference numerals designate like parts in the several figures, and initially to FIG. 1, wherein a cable connector constructed in accordance with the present invention, generally designated by reference numeral 1, is shown, the cable connector 1 comprises a pin carrier 20 made of an insulative material, having a first side face 21 and an opposite second side face 22 with a plurality of pin receiving holes 211 defined therebetween each receiving a conductive pin 23 therein. In the embodiment illustrated, the pin receiving holes 211 are arranged in two parallel rows separated by a partition wall defining a groove 25 therealong for receiving grounding means 4 comprising two conductive grounding plates 41, 42.

A cover member 3 is provided to mount to the pin carrier 20 to interpose therebetween a flat ribbon cable 5 comprising plural parallel signal conductors 51 and grounding conductors 52 retained in position by means of cable insulation 50, the signal conductors 51 and the grounding conductors 52 being alternately arranged with each other for the purpose of suppressing cross-talk between adjacent signal conductors 51. The cover member 3 comprises two resilient arms 31 each defining an opening (not label) therein. The pin carrier 20 defines two slots 24, which, in the embodiment illustrated, are respectively located at opposite ends of the pin carrier 20, for respectively receiving the resilient arms 31 of the cover member 3 therein. A barb 241 extends into each of the slots 24 for engaging with the respective resilient arm 31 thereby securing the cover member 3 to the second side face 22 of the pin carrier 20.

Preferably, the cover member 3 is positioned on the second side face 22 of the carrier body 2 whereby a plurality of recesses 32 defined in the cover member 3 correspond to the signal and grounding conductors 51, 52 thereby accommodating the conductors 51, 52 therein and more tightly and securely retaining the cable 5 between the cover member 3 and the pin carrier 20.

Figure 2:
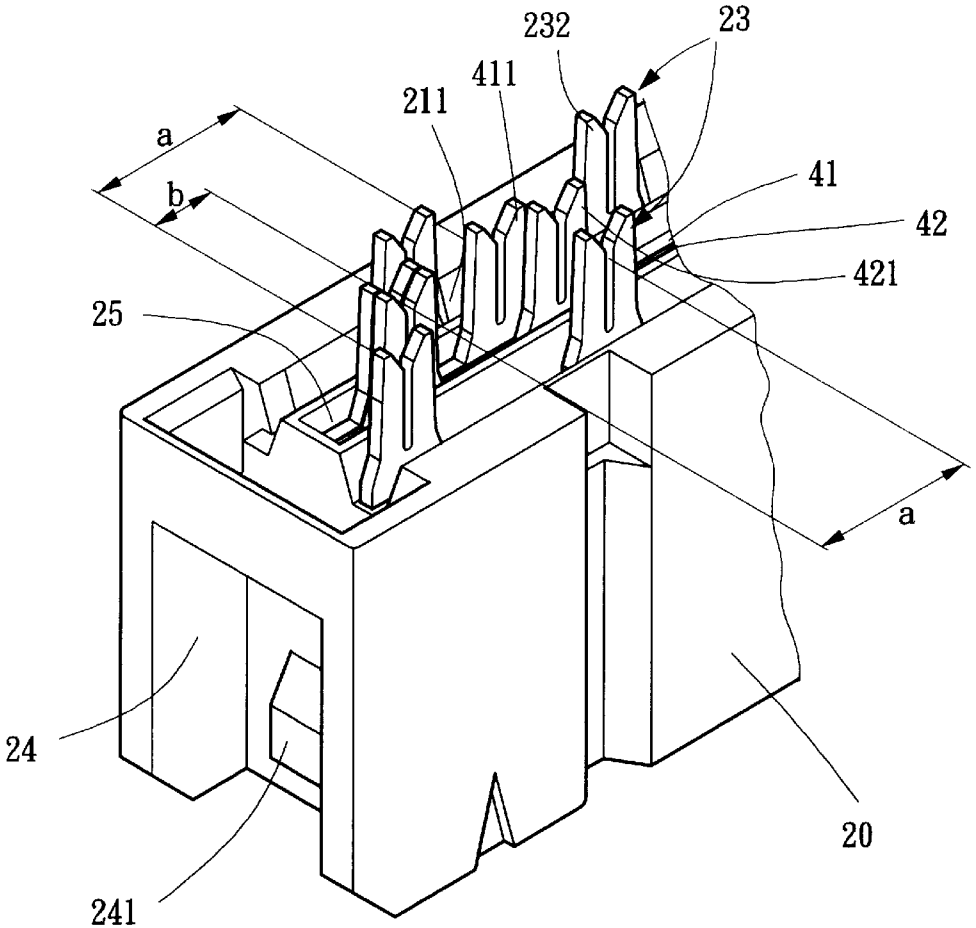
FIG. 2 is a partial perspective view of the partly assembled cable connector.
Figure 3:
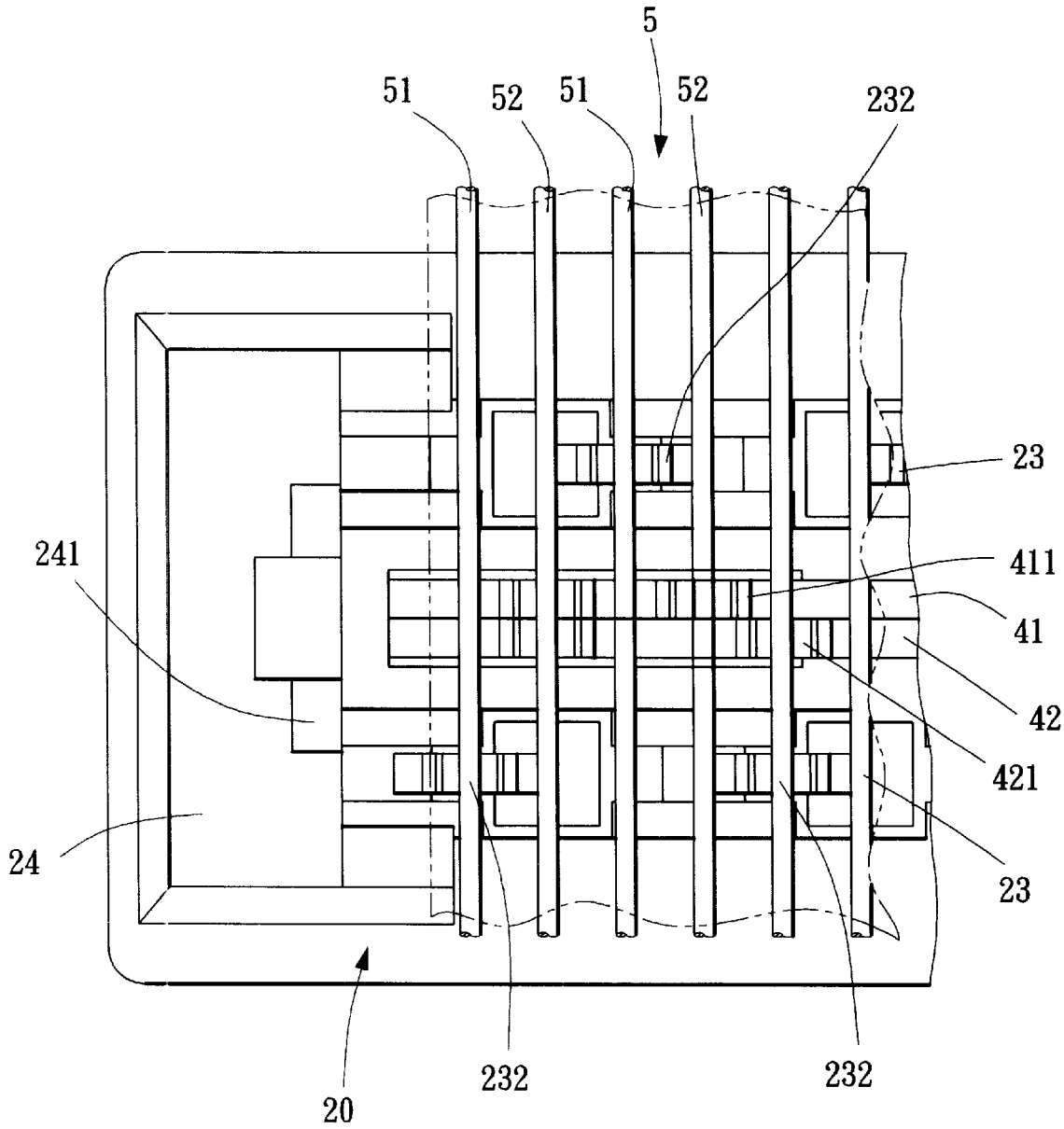
FIG. 3 is a top plan view of FIG. 2; with the flat ribbon cable being super posed thereon
Figure 4:
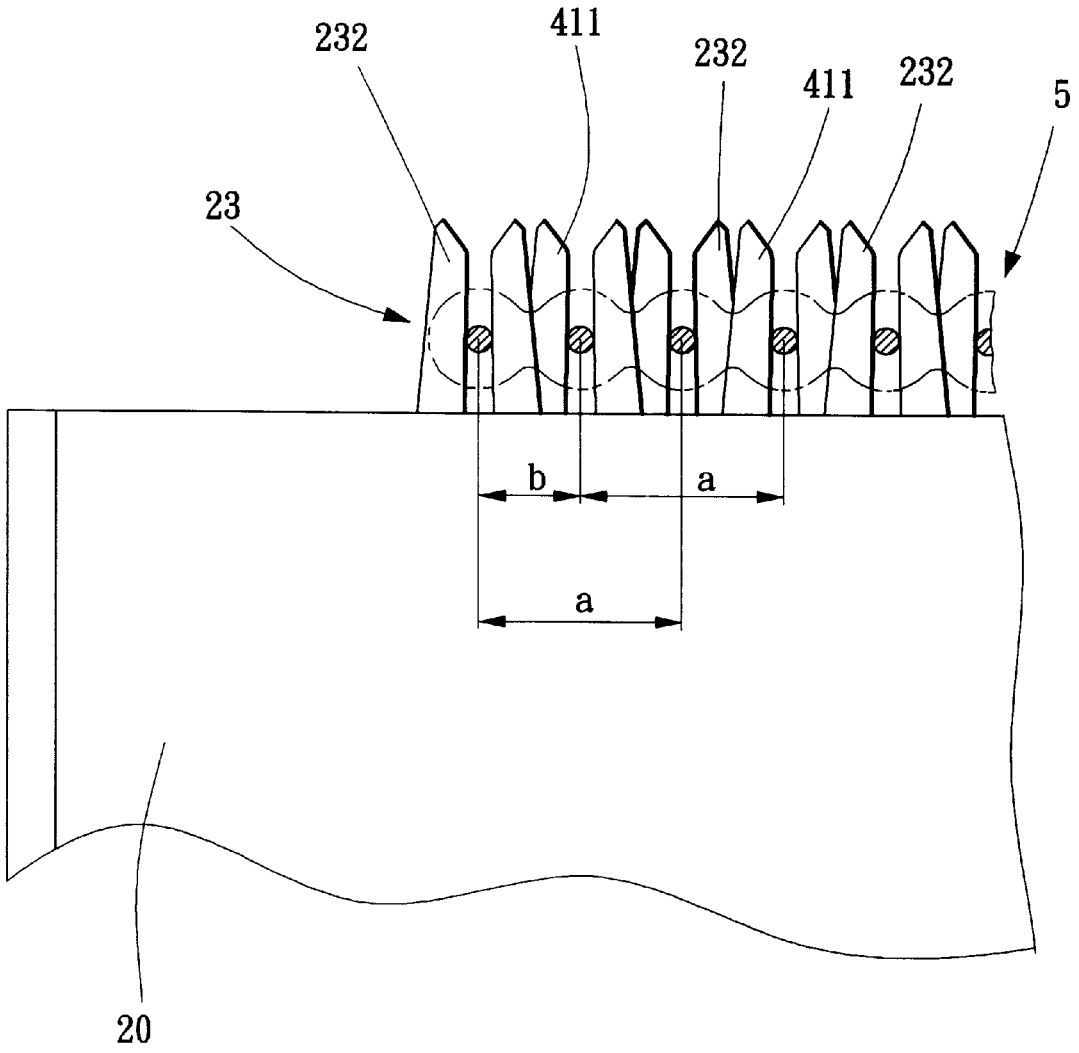
FIG. 4 is a side elevational view of FIG. 3.

Also referring to FIGS. 2, 3 and 4, the two rows of pins 23 received in the pin receiving holes 211 are alternately arranged with each other whereby the distance between a particular pin in the first row and an adjacent pin in the second row substantially corresponds to the distance between two adjacent signal conductors 51 of the flat ribbon cable 5, namely the distance designated with reference character "a" in the drawings. In other words, the distance between two adjacent pins 23 in each row is substantially equal to twice the distance "a". It should be noted that the distance between adjacent conductors 51, 52 in the flat ribbon cable 5 is indicated by reference character "b" in the drawings which is, quite apparently, half the distance "a", if the signal and grounding conductors 51, 52 are identical.

Each of the pins 23 has a first end 231 located in the respective pin receiving hole 211 proximate the first side face 21 of the pin carrier 20 and adapted to be engaged by a counterpart external device (not shown) and an opposite second end 232 which partially projects beyond the second side face 22 of the pin carrier 20. The second end 232 of the pin 23 is bifurcated to complete an insulation displacement type engagement with the signal conductors 51. The flat ribbon cable 5 is positioned on the second side face 22 of the pin carrier 20 whereby each of the signal conductors 51 corresponds to each of the pins 23. By means of mounting the cover member 3 to the second side face 22 of the pin carrier 20, the insulation 50 of signal conductors 51 is pierced by the bifurcated second ends 232 of the corresponding pins 23 thereby establishing an electrical connection between the signal conductors 51 and the corresponding pins 23.

The conductive plates 41, 42 of the grounding means are provided with bifurcated projections 411, 421, wherein the bifurcated projections 411 of the first conductive plate 41 correspond with the grounding conductors 52 of the flat ribbon cable 5. An insulation displacement occurs on the grounding conductors 52 with respect to the bifurcated projections 411 of the first conductive plate 41 thereby establishing electrical connection therebetween when the cover member 3 is attached to the pin carrier 20.

The bifurcated projections 421 of the second conductive plate 42 of the grounding means 4 are located at positions corresponding to the signal conductors 51 of the flat ribbon cable 5 that require a grounding signal or ground potential whereby the locations of the bifurcated projections 421 of the second conductive plate 42 are coincident with those of the bifurcated projections 411 of the first conductive plate 41 associated the signal conductors 51 of the flat ribbon cable 5 that require the grounding signal or grounding potential.

Preferably, electrical connection is established between the first and second conductive plates 41 and 42 of the grounding means 4.

Although the present invention has been described with respect to the preferred embodiment thereof, it is obvious that equivalent alterations and modifications will occur to those skilled in the art upon the reading and understanding of the above detailed description. The present invention includes all such equivalent alterations and modifications and is limited only by the scope of the appended claims.

What is claimed is:

1. A cable connector adapted to be coupled with a flat cable comprising plural parallel and alternately arranged signal conductors and grounding conductors retained in position with insulative material, comprising:

an insulative pin carrier having a first side face and an opposite second side face, a plurality of holes defined between the first side face and the second side face, the holes being arranged in two rows, and a groove being defined between the two rows of the holes and along the second side face of the pin carrier;

a conductive pin received in each of the holes of the pin carrier corresponding to the respective signal conductor of the flat cable, each conductive pin having a first end located in the hole proximate the first side face of the pin carrier and a second bifurcated end partially projecting beyond the second side face of the pin carrier;

grounding means comprising a first conductive plate having a plurality of bifurcated projections corresponding to the grounding conductors of the flat cable, the first conductive plate being received and retained in the groove with the bifurcated projections thereof partially extending beyond the second side face of the pin carrier;

a cover member being attached to the second side face of the pin carrier and comprising means for securing the flat cable thereunder, whereby the flat cable is interposed between the cover member and the second side face of the pin carrier to complete an insulation displacement connection between the signal conductors of the flat cable and the corresponding pins and between the grounding conductors of the flat cable and the bifurcated projections of the first conductive plate, wherein the grounding means comprises a second conductive plate received in the groove and having at least one bifurcated projection corresponding to at least one of the signal conductors of the flat cable that is to be provided with a grounding potential.

2. The cable connector as claimed in claim 1, wherein the two rows of holes are separated by a partition wall.

3. The cable connector as claimed in claim 2, wherein the pins received in the holes of the two rows are alternately arranged with respect to each other.

4. The cable connector as claimed in claim 3, wherein a distance between one of the pins in a first row and an adjacent pin in a second row corresponds to twice the distance between adjacent conductors of the flat cable.

5. The cable connector as claimed in claim 1, wherein the second conductive plate is electrically connected to the first conductive plate.

6. The cable connector as claimed in claim 1, wherein the cover member comprises two resilient arms and wherein the pin carrier defines two slots for respectively receiving the two resilient arms therein, securing means being provided between each of the resilient arms and the respective slot thereby securing the cover member to the pin carrier.

7. The cable connector as claimed in claim 6, wherein the securing means comprises an opening defined through the resilient arm and a barb extending into the slot for engaging the opening of the resilient arm thereby securing the cover member to the pin carrier.

8. The cable connector as claimed in claim 1, wherein the means of the cover member comprises a surface in contact engagement with the flat cable, the surface having a configuration corresponding to the flat cable thereby securely retaining the flat cable in position.

9. The cable connector as claimed in claim 8, wherein the configuration of the surface of the cover member comprises a plurality of recesses each receiving one of the conductors of the flat cable therein.

10. The cable connector as claimed in claim 2, wherein the groove for accommodating the grounding means is defined along the partition wall.

11. A cable assembly comprising:

a flat cable comprising plural parallel and alternately arranged signal conductors and grounding conductors retained in position with insulative material; and a cable connector comprising:

an insulative pin carrier defining a groove therein;

two rows of staggered conductive pins positioned by two sides of said groove corresponding to the respective signal conductors of the cable wherein a conductive pin of one row is distanced, in a lengthwise direction along said rows, fran another adjacent conductive pin of the other row with a first distance equal to that between two adjacent signal conductors of the cable; and grounding means positioned within the groove and comprising a first conductive plate having a plurality of bifurcated projections corresponding to the grounding conductors of the cable wherein the bifurcated projections are arranged in one row and a second distance between two adjacent projections is equal to that between two adjacent grounding conductors of the cable; wherein said grounding means further includes a second conductive plate received within the groove and having at least a bifurcated projection corresponding to at least one of the signal conductors of the cable that is to be provided with a grounding potential.

12. The cable assembly as claimed in claim 11, wherein said first distance is equal to said second distance.

13. The cable assembly as claimed in claim 11, wherein a third distance between a conductive pins and an adjacent projection of the grounding means is equal to that between a signal conductor and an adjacent grounding conductor of the cable.

14. The cable assembly as claimed in claim 13, wherein said first distance is twice the third distance.

15. The cable assembly as claimed in claim 11, wherein said second conductive plate is electrically connected to the first conductive plate.

16. A cable assembly comprising:

a flat cable comprising plural parallel and alternately arranged signal conductors and grounding conductors retained in position with insulative material; and a cable connector comprising:

an insulative pin carrier;

two rows of staggered conductive pins positioned in the pin carrier corresponding to the respective signal conductors of the cable; and grounding means positioned within the pin carrier and comprising a first conductive plate having a plurality of bifurcated projections electrically connected to the grounding conductors of the cable, and a second conductive plate having at least one bifurcated projection electrically connected to at least one selected signal conductor which is designated to require ground potential; wherein said first conductive plate and said second conductive plate extend along a lengthwise direction of the pin carrier in a parallel relationship therebetween, and are electrically connected to each other.

17. The cable assembly as claimed in claim 16, wherein said first conductive plate and said second conductive plate are closely positioned with each other between the two rows of the conductive pins.

* * * * *